US006571992B2

(12) United States Patent
Pierson et al.

(10) Patent No.: US 6,571,992 B2
(45) Date of Patent: Jun. 3, 2003

(54) DISPENSING SYRINGE

(75) Inventors: Paul R. Pierson, Camden, DE (US); Curt E. Metzbower, Wyoming, DE (US)

(73) Assignee: Dentsply Research & Development Corp.

( * ) Notice: Subject to any disclaimer, the term of this patent is extended or adjusted under 35 U.S.C. 154(b) by 0 days.

(21) Appl. No.: 10/044,474

(22) Filed: Jan. 10, 2002

(65) Prior Publication Data

US 2002/0113088 A1 Aug. 22, 2002

Related U.S. Application Data

(60) Provisional application No. 60/261,145, filed on Jan. 12, 2001.

(51) Int. Cl.[7] ..... B67D 5/42
(52) U.S. Cl. ..... 222/390
(58) Field of Search ..... 222/390

(56) References Cited

U.S. PATENT DOCUMENTS

| | | | | |
|---|---|---|---|---|
| 1,061,323 A | * | 5/1913 | Powers | 184/45.1 |
| 3,212,685 A | * | 10/1965 | Swan et al. | 222/386 |
| 3,281,023 A | * | 10/1966 | Bruck et al. | 222/390 |
| 4,184,490 A | | 1/1980 | Jacklich | 128/236 |
| 4,189,065 A | | 2/1980 | Herold | 222/46 |
| 4,269,331 A | | 5/1981 | Watson | 222/390 |
| 4,479,781 A | | 10/1984 | Herold et al. | 433/90 |
| 4,498,904 A | | 2/1985 | Turner et al. | 604/211 |
| 4,560,352 A | | 12/1985 | Neumeister et al. | 433/90 |
| 4,710,179 A | | 12/1987 | Haber et al. | 604/211 |
| 4,732,302 A | | 3/1988 | Muhlbauer | 222/390 |
| 4,863,072 A | | 9/1989 | Perler | 222/390 |
| 4,909,788 A | | 3/1990 | Egolf | 604/187 |
| 5,267,859 A | | 12/1993 | Discko, Jr. | 433/89 |
| 5,531,709 A | | 7/1996 | Eykmann et al. | 604/218 |
| 5,603,701 A | | 2/1997 | Fischer | 604/211 |
| 5,618,273 A | | 4/1997 | Fischer | 604/211 |
| 5,620,423 A | | 4/1997 | Eykmann et al. | 604/217 |
| 5,647,856 A | | 7/1997 | Eykmann et al. | 604/181 |
| 5,961,491 A | | 10/1999 | McGary et al. | 604/110 |
| 5,997,514 A | | 12/1999 | Balestracci | 604/227 |

FOREIGN PATENT DOCUMENTS

| | | |
|---|---|---|
| DE | 857 576 | 12/1952 |
| DE | 91 00 284 | 1/1991 |
| DE | 295 21 073 | 8/1996 |
| GB | 1 515 219 | 8/1976 |
| GB | 2 106 596 | 4/1983 |
| GB | 2 339 453 | 1/2000 |
| WO | 00/16829 | 3/2000 |

* cited by examiner

*Primary Examiner*—Gene Mancene
*Assistant Examiner*—Stephanie Willatt
(74) *Attorney, Agent, or Firm*—Doulglas J. Hura; James B. Bieber

(57) ABSTRACT

A dispensing syringe (10) has a barrel (20) keyed (31, 32) to a gripping assembly (40) having complementary keyed surfaces (42). A nut having dual threads (61, 62) of differing diameters is threaded to one end of the barrel (20) and receives a matingly threaded (71) plunger (70). Turning the plunger (70) causes it to advance within the barrel (20) due to the interaction of the mating threads (61, 71). The gripping assembly (40) is provided with winged projections (50) that facilitate handling and manipulation of the syringe (10). The complementary keyed surfaces (31, 32 and 42) physically interact so as to prevent the gripping assembly (40) from turning or twisting about the barrel (20) during use.

4 Claims, 2 Drawing Sheets

DISPENSING SYRINGE

This application claims the benefit of provisional application No. 60/261,145 filed Jan. 12, 2001.

TECHNICAL FIELD

The present invention is generally directed toward syringes used to dispense a flowable material. More particularly, the invention is directed toward such a syringe having a threaded plunger that is used to push the material from the syringe. More specifically, the invention includes such a syringe with a winged grasping structure that allows for improved handling and manipulation of the syringe by a user.

BACKGROUND OF THE INVENTION

Some competitive syringes (3M for example) have placed winged extensions on the threaded nut, which secures the screw plunger to the syringe barrel. This is undesirable because it directs the use to grasp the nut and not the barrel. By doing so the nut is held stationary and the frictional forces of turning the screw plunger act to unintentionally back the nut off of the barrel. Other syringes (Ultradent, Cosmedent and Vivadent) use a sliding nut mechanism which secures the nut to the barrel and prevents t from turning. This is desirable, but it does not assist the use in getting a better grip on the syringe. Syringes used by Kulzer, Jeneric/Pentron, and 3M incorporate this same sliding nut principle but also incorporate extensions apparently for better gripping but they are either too small to be effective or too thick to fit comfortably in the users hand. The winged extensions on our new syringe are thin like the wings on an airplane and they fit comfortably between the fingers. In addition, they are offset to one side of the barrel providing a comfortable fit in the user's hand. Still other syringes (Discus and Kerr) simply have a threaded nut on the en of a threaded barrel and don't o anything to counter act the forces that tend to back off the nut.

SUMMARY OF THE INVENTION

It is therefore, an object of the present invention to provide a syringe useful for dispensing dental or other materials.

It is another object of the invention to provide such a syringe that can be easily and efficiently manipulated by the user thereof.

It is still another object of the invention to provide such a syringe useful for the dispensing of materials which is provided with an improved structure for grasping the syringe.

These and other objects of the invention, which will become apparent from the present discussion, are accomplished by the invention as hereinafter described and claimed.

In general, a dispensing syringe comprises a barrel having a through-bore therein extending between and connecting an inlet orifice and an outlet orifice of the barrel. The barrel is also provided with an external keyed and threaded portion proximate to the inlet orifice. A gripping assembly is provided having an internal bore and receivable onto said barrel, by passing said barrel through said bore of said gripping assembly. The bore of said gripping assembly having a complementary shape to at least a portion of the external keyed portion of said barrel, such that when the gripping assembly is received onto said barrel, said external keyed and threaded portion proximate to the inlet orifice of said barrel is physically engaged with the internal complementary portions of the bore of said gripping assembly. The threaded portion of said external keyed and threaded portion proximate to the inlet orifice of said barrel is of sufficient length such that when said gripping assembly is received onto said barrel in the complementary keyed relation, at least a part of the threaded portion of said barrel extends through and physically beyond said gripping assembly. The gripping assembly having at least two opposed wing projection extending therefrom, such that each of said wing projections has at least one surface plane disposed at an angle to a similar surface plane of the other wing projection. The syringe also includes a nut having concentrically disposed first and second diameter threads therein and having a nut through-bore therein, such that said nut is receivable onto said barrel in threaded engagement between said first concentric threads thereof and said external threads of said barrel. The syringe further having an externally threaded plunger receivable within said nut such that the external threads of the plunger threadably interact and cooperate with said second concentric threads of said nut. Said threads of said plunger and said second concentric threads of said nut, being of such cooperating configuration that turning of said plunger in one direction will cause said plunger to advance within said bore of said nut and hence, within said through-bore of said barrel. Material contained within said through-bore will thereby be pushed or caused to move toward said outlet orifice of said barrel to thereby be dispensed therefrom.

PREFERRED EMBODIMENTS FOR CARRYING OUT THE INVENTION

A syringe according to the present invention is generally designated by the number 10 on the attached drawings. Syringe 10 is preferably fabricated by molding its individual components from a suitable plastic, rubber or other similar material. Any material is within the scope of the invention.

Figure 1:
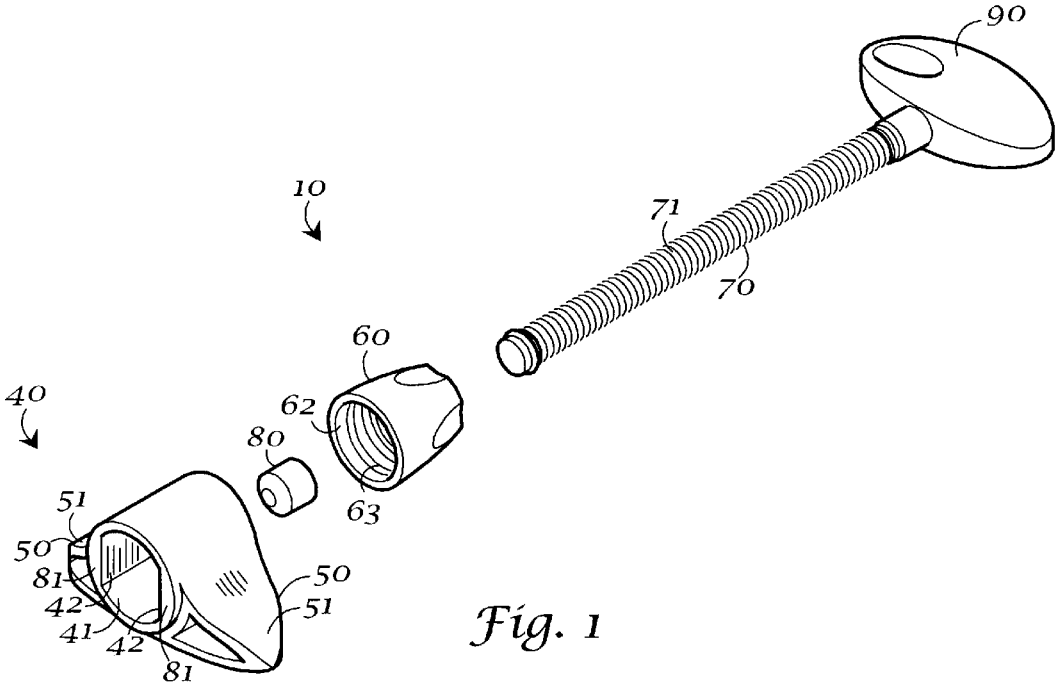
FIG. 1 is an exploded, perspective view of the various cooperating component parts of a dispensing syringe according to the present invention.
Figure 6:
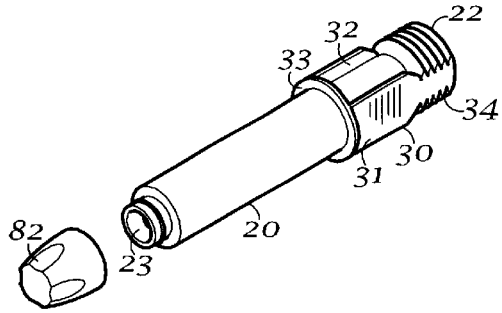
FIG. 6 is a side elevation, sectional view of the nut used with the syringe of FIG. 1.
Figure 6:
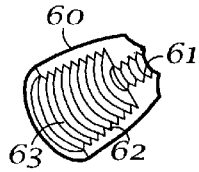
Figure 2:
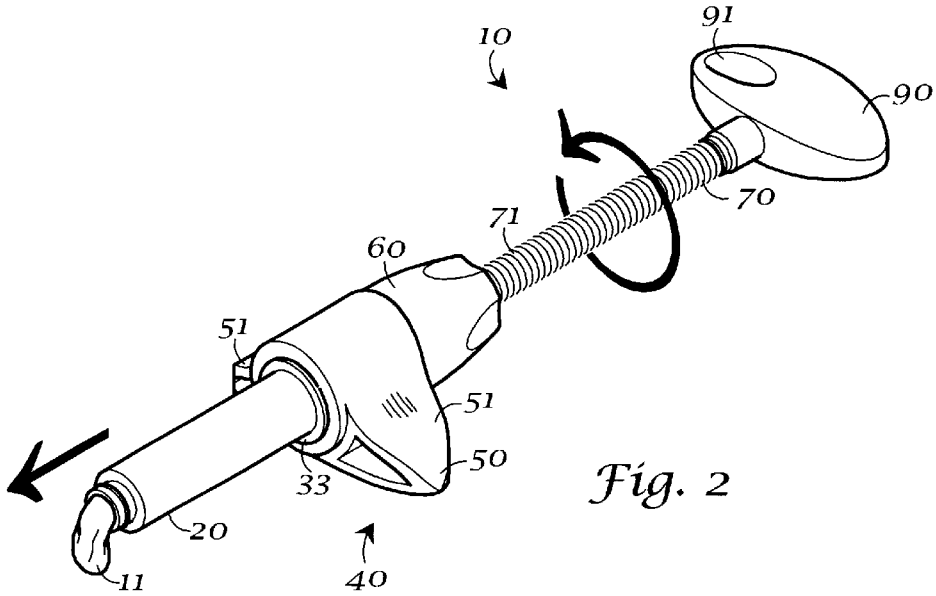
FIG. 2 is a perspective view of an assembled syringe according to claim 1, showing an amount of a material being dispensed from an outlet orifice thereof for environmental purposes.
Figure 4:
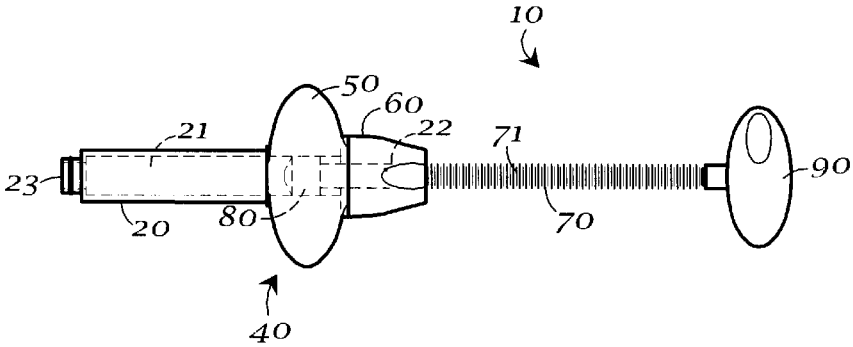
FIG. 4 is a bottom plan view of the assembled syringe of FIG. 1.
Figure 3:
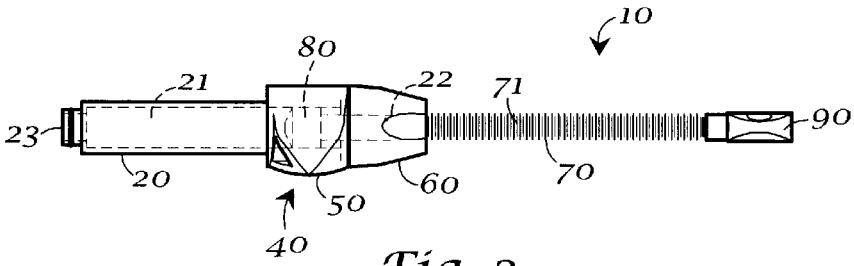
FIG. 3 is a side plan view of the assembled syringe of FIG. 1.
Figure 5:
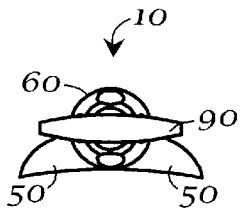
FIG. 5 is a rear view of the syringe of FIG. 3.

Syringe 10 is useful for dispensing any flowable material, but is particularly adapted for dispensing flowable materials having viscosities greater than that of water, such as pastes, putties and the like. Such materials are represented as material 11 on the drawings (FIG. 2). It is often difficult to make such materials flow under the influences of gravity alone, except perhaps only after extended periods of time. Certain of these materials such as dental restoratives and the like, can be dispensed according to the syringe of the present invention. Broadly speaking, the present invention provides syringe 10 to store, transport and dispense material 11.

Dispensing syringe 10 comprises a barrel 20 having a through-bore 21 therein extending between and connecting an inlet orifice 22 and an outlet orifice 23 of barrel 20. The barrel 20 is also provided with an external keyed and threaded portion 30 proximate to the inlet orifice 22. Keyed structures are well known in a number of arts, and keyed and threaded portion 30 may be of any shape or design. One preferred keyed portion 30 includes straight walls 31 and 32 positioned on either side of barrel 20, in a spaced, opposed and parallel manner to each other. Keyed portion 30 may also include a stop wall 33, whose function will be more fully explained hereinbelow. Barrel 20 is also preferably provided with external threads 34 proximate to inlet orifice 22 of barrel 20, whose function will also be below described.

A gripping assembly 40 is provided having an internal bore 41 and receivable onto barrel 20, by passing barrel 20 through bore 41 of gripping assembly 40. The bore 41 of gripping assembly 40 preferably is provided with a complementary shape to at least a portion of the external keyed portion 30 of barrel 20, such that when the gripping assembly 40 is received onto barrel 20, external keyed 30 and threaded portion 34 proximate to the inlet orifice 22 of barrel 10 is physically engaged with the internal complementary portions of the bore 40 of gripping assembly 41. According to one embodiment, internal bore 41 is at least partially defined by sidewalls 42, which are of complementary spaced, parallel and opposing relation to the straight walls 31 and 32 of barrel 20. As will be appreciated, by being keyed to barrel 20, interaction between surfaces or walls 31, 32 and 42 will prevent gripping assembly 40 from twisting or turning on barrel 20 in use.

The threaded portion 34 proximate to the inlet orifice 22 of barrel 20 is of sufficient length such that when gripping assembly 40 is received onto barrel 20 in the complementary keyed relation as described and shown in the drawings, at least a part of the threaded portion 34 of barrel 20 extends through and physically beyond gripping assembly 40, for reasons that will become clear in the discussion to follow.

The gripping assembly 40 preferably has at least two opposed wing projections 50 extending therefrom, such that each wing projection 50 has at least one surface 51, the plane of which is disposed at an angle to a similar surface plane of the other wing projection 50. That is, the wing projections 50 preferably extend from gripping assembly 40 at an angle to each other.

The syringe 10 also includes a nut 60 having concentrically disposed first diameter threads 61 and second diameter threads 62 therein and having a nut through-bore therein 63. Nut 60 is receivable onto barrel 20 in threaded engagement between second concentric threads 62 thereof and external threads 34 of barrel 20.

The syringe 10 further has an externally threaded plunger 70 having external threads 71 and receivable within nut 60 bore 63, such that the external threads 71 of the plunger 70 threadably interact and cooperate with first concentric threads 61 of nut 60. Threads 71 of plunger 70 and first concentric threads 61 of nut 60, being of such cooperating configuration that turning of said plunger in one direction such as that shown by arrow 72, will cause plunger 70 to advance within 63 bore of nut 60 and hence, within through-bore 21 of barrel 20. Material 11 contained within through-bore 21 will thereby be pushed or caused to move toward outlet orifice 23 of barrel 20 to thereby be dispensed therefrom. It will be appreciated that a user (not shown) can grasp gripping assembly 40 to facilitate such an action, and particularly will make use of wing projections 50 in such manipulation.

Wing projections 50 need not be angled with respect to each other as described and shown, but preferably are so angled. With respect to each other, wing projections 50 may be symmetrical or asymmetrical, though angled and offset as shown is preferred. This position creates a convenient and comfortable thumb rest for a user, and allows the syringe 10 to be held and manipulated in a number of ways as may be desired by the user. It will also be appreciated that by using a plurality and preferably two wing projections 50, the syringe 10 is equally usable by a right- or left-handed user. It will also be understood that while wing projections 50 are preferably integrally molded or otherwise formed with gripping assembly 40, they may also be separately physically affixed thereto. Also, the design of nut 60 may be of the sliding type (not shown) as is known in the art, and still fall within the scope of the present invention.

Syringe 10 may also be provided with a piston 80 at one end of plunger 70, and may be snap-fit or otherwise connected to plunger 70. Although not shown, a plunger 80 may also be unconnected to plunger 70, but in any case if used, is preferably placed in throughbore 21 of barrel 20 between material 11 and plunger 70, so as to facilitate the moving of material 11 within throughbore 21 as was described above.

According to one preferred aspect of the invention, wing assembly 40 is provided with stop shoulders 81, preferably formed by sidewalls 42, which act so as to physically engage stop wall 33 of barrel 20, when gripping assembly 40 is appropriately positioned and received upon barrel 20. The position of stop wall 33 is thus predetermined so that during assembly, gripping assembly 40 is placed onto barrel 20 until the physical and limiting engagement between gripping assembly 40 and stop wall 33 is achieved. Barrel 20 is filled with material 11 either before or after assembly of syringe 10, and a cap 82 may used to close outlet orifice 23 until it is desired to dispense material 11.

It is another aspect of the invention to provide a turning knob 90 on plunger 70, to facilitate turning thereof. Knob 90 may also be provided with an insert 91. Insert 91 may be of any material, but preferably is of a rubber-like material that improves a user's grip upon knob 90. Insert 91 may also be color coded as an indicia of the material 11 within barrel 20. Although not shown, wing projections 50 or any other portion of syringe 10 may also be provided with similar inserts 91.

It should be apparent that a syringe for dispensing material accomplishes the objects of the invention as set forth above, and otherwise provides an advancement to the art. The syringe as described and shown herein does not necessarily depict all aspects of the invention that may be varied and still fall within its scope. The scope of the invention shall therefore, be determined by the attached claims.

What is claimed is:

1. A dispensing syringe comprises a barrel having a through-bore therein extending between and connecting an inlet orifice and an outlet orifice of said barrel; said barrel is also provided with an external keyed and threaded portion proximate to said inlet orifice; a gripping assembly is provided having an internal bore and receivable onto said barrel, by passing said barrel through said bore of said gripping assembly; said bore of said gripping assembly having a complementary shape to at least a portion of said external keyed portion of said barrel, such that when said gripping assembly is received onto said barrel, said external keyed and threaded portion proximate to the inlet orifice of said barrel is physically engaged with said internal complementary portions of said bore of said gripping assembly; said threaded portion of said external keyed and threaded portion proximate to said inlet orifice of said barrel is of sufficient length such that when said gripping assembly is received onto said barrel in said complementary keyed relation, at least a part of said threaded portion of said barrel extends through and physically beyond said gripping assembly; said gripping assembly having at least two opposed wing projections extending therefrom, such that each of said wing projections has at least one surface plane disposed at an angle to a similar surface plane of the other wing projection; the syringe also including a nut having concentrically disposed first and second diameter threads therein and having a nut through-bore therein, such that said nut is receivable onto said barrel in threaded engagement between said first concentric threads thereof and said external threads of said barrel; the syringe further comprising an externally threaded plunger receivable within said nut such that said external threads of said plunger threadably cooperate with said second concentric threads of said nut; said threads of said plunger and said second concentric threads of said nut, being of such cooperating configuration that turning of said plunger in one direction will cause said plunger to advance within said bore of said nut and hence, within said throughbore of said barrel.

2. A syringe as in claim 1, wherein said barrel is provided with a stop wall that physically engages said gripping assembly when said gripping assembly is received upon said barrel.

3. A syringe as in claim 1, wherein said plunger is provided with a piston at one end, said piston being receivable within said throughbore of said barrel.

4. A syringe as in claim 1, wherein said plunger is provided with a turning knob at one end thereof.

* * * * *